United States Patent [19]

Miraglia, Jr.

[11] Patent Number: 5,018,441

[45] Date of Patent: May 28, 1991

[54] PORTABLE SCREEN PRINTER

[76] Inventor: Humbert G. Miraglia, Jr., 1409 North St., Corning, Calif. 96021

[21] Appl. No.: 290,562

[22] Filed: Dec. 27, 1988

[51] Int. Cl.[5] ..... B41L 13/18

[52] U.S. Cl. ..... 101/123; 101/127; 101/128

[58] Field of Search ..... 101/114, 115, 123, 126, 101/127, 127.1, 129; 248/289.1, 285, 528, 188.6; 403/109, 110, 379, 92, 93; 16/324, 343

[56] References Cited

U.S. PATENT DOCUMENTS

| | | | |
|---|---|---|---|
| 1,697,652 | 1/1929 | Jackson | 16/324 |
| 2,484,671 | 10/1949 | Bauman | 101/115 |
| 2,502,926 | 4/1950 | Chadwich et al. | 101/129 |
| 3,096,709 | 7/1963 | Eldred et al. | 101/115 |
| 3,427,964 | 2/1969 | Vasilantone | 101/126 |
| 3,604,734 | 9/1971 | Friedman | 403/109 |
| 4,084,504 | 4/1977 | Fuchs | 101/115 |
| 4,099,460 | 11/1976 | Bubley et al. | 101/115 |
| 4,315,461 | 2/1982 | Harpold | 101/115 |
| 4,388,862 | 6/1983 | Thomas | 101/126 |
| 4,458,379 | 3/1984 | Shelton | 16/324 |
| 4,478,144 | 10/1984 | Maloof | 101/127 |
| 4,606,268 | 8/1986 | Jaffa | 101/126 |
| 4,649,815 | 3/1987 | Richardson | 101/126 |
| 4,708,057 | 11/1987 | Hogenson | 101/127.1 |
| 4,722,272 | 7/1988 | Caruccio | 101/126 |

OTHER PUBLICATIONS

Antec–"Screen Printing Equipment Engineered for the Hands".

*Primary Examiner*—Edgar S. Burr
*Assistant Examiner*—Joseph R. Keating

[57] ABSTRACT

A portable screen printing apparatus useful for printing designs, lettering, and numerals on garments and other articles containing novel screen holder assemblies which allow variable positioning of the thermal printing screen over the surface of the garment. The screen printing apparatus consists generally of a support base, four positionable screen holder assemblies hingedly affixed to a pivoting plate, an elevating plate, and a platform supporting the article to be printed on. Each screen holder assembly consists basically of a two panel telescoping frame endwardly affixed with a U-shaped channel. The channel is affixed with two thumb screws for securing the thermal frame portion of a thermal printing screen. The top telescoping panel with the U-shaped channel endwardly attached, can be extended longitudinally over the surface of the garment on the article platform. This allows a reduction in the size of the thermal printing screens, and therefore a reduction in costs, due to the positioning ability of the screen holders.

1 Claim, 5 Drawing Sheets

PORTABLE SCREEN PRINTER

BACKGROUND OF THE INVENTION

1. Field of the Invention

This invention relates to equipment used in the process of thermal screen printing particularly equipment useful for printing designs, letters and numbers on T-shirts. More precisely, the immediate invention is a portable, multi-color positionable screen frame thermal printer which can utilize small thermal printing screens.

2. Description of the Prior Art

The prior art teaches a wide variety of multi-color screen printers for use in printing designs on a wide variety of articles. The screens used for this process are printed by a thermal process with a design and stretched and edgewardly fixed onto a rectangular frame to keep the design taught during printing. When a multicolor design is used, a separate screen must be created for each different color in the design. Care must be taken to assure accurate placement of each separate screen as each consecutive color is added. Misalignment of the screens will cause an undesirable overlapping of the edges of the separate colors. Multiple rotatable screen clamps now in use make accurate alignment of the separate colors of a multi-color design possible. Framed print screens releasably affix two or more screens onto a rotating base which accurately aligns each screen, one at a time, over the garment are used. In the past art, however, many printers shown are designed to hold a certain size screen in a fixed position or are assembled in such a way as to make easy transportation of the printer unfeasible. Specifically, the major drawback to the existing screen printers is the inability of the apparatus which secures the screen to be positioned past the lower edge of the garment support surface due to underhanging obstructions on the bottom side of the clamp. When adjustability of the screen clamp is limited, full size screens are required even if a small design is used. The material used and the process of creating each screen is not inexpensive. Reducing the screen size as can be done with the present invention results in substantial savings, especially for the small businessman.

SUMMARY OF THE INVENTION

In practicing my invention, therefore, in a preferred embodiment, I provide a portable thermal screen printer with four color rotational mechanics for use in printing articles such as T-shirts. A second embodiment is provided in a one color, non-rotational screen printer. The preferred embodiment comprises basically a rectangular horizontal base, four positionable screen clamps attached to a rotatable support structure, and one horizontal garment support platform. One of the novel features of my device is a positionable screen clamp or holder which extends over the surface of the garment support platform. Free movement of the holder allows considerable more range in my device for positioning the screen than is seen in other devices. This greater screen positioning ability allows the size of the screen to be reduced. Free movement of a small screen is quite cost effective especially if the design is small. Both embodiments of my printer use a U-shaped channel, along with a clamping means, which serves to retain one edge of the framed thermal screen for secure positioning during printing. The bottom surface of the U-shaped channel lies flush on the surface of the garment support platform and can extend the screen one half to three fourths of the platforms length. In past art disclosures and in other marketed printers, the screen clamp can not move further then the bottom edge of the garment support platform. This restriction prevents use of small screens readily repositioned over the garment platform and requires screen changes rather than easy screen movement. My device eliminates the base stop restriction and the bottom ledge of my U-shaped channel is thin to decrease the distance the screen is suspended from the garment surface. Since the majority of screens are blocked onto the bottom surface of their respective frames, the only distance between the screen and the garment is the thickness of the bottom ledge of the U-shaped clamp. In many past art printers, the clamping means is so thick that even if moving the base of the screen in the clamp past the edge of the garment support platform were possible, the raised edge of the screen would spoil the print surface contact. If printing is tried with the screen forced up, fuzzy edges are the results and no good prints are obtained. In my device, having the lower clamp edge thin allows free movement of the clamped screen to a variety of positions on the garment support platform without any adverse effect to the prints.

Another feature of my device is portability. This is accomplished because in my printer, the screen holders fold easily, and no attachment to a support structure is necessary. My device can be placed on any level surface with no assembly or attachment of integral parts required. The wide base provides balance and support and the overall small size makes transporting my thermal printer easy.

Therefore, a primary objective of my invention is to provide in one to four screen holding thermal screen printers positionable screen holders which can extend over and lie flush with the surface of the garment support platform.

Another object of my invention is to provide a thermal screen printer which can effectively position and use small size screens.

An even further object of my invention is to provide a thermal screen printer which is portable and requires no set-up assembly.

Other objects and advantages of my invention will become apparent upon examination of the following specification and comparison of numbered parts described with like numbered parts illustrated in the accompanying drawings.

DESCRIPTION OF THE PREFERRED EMBODIMENT

Figure 1:
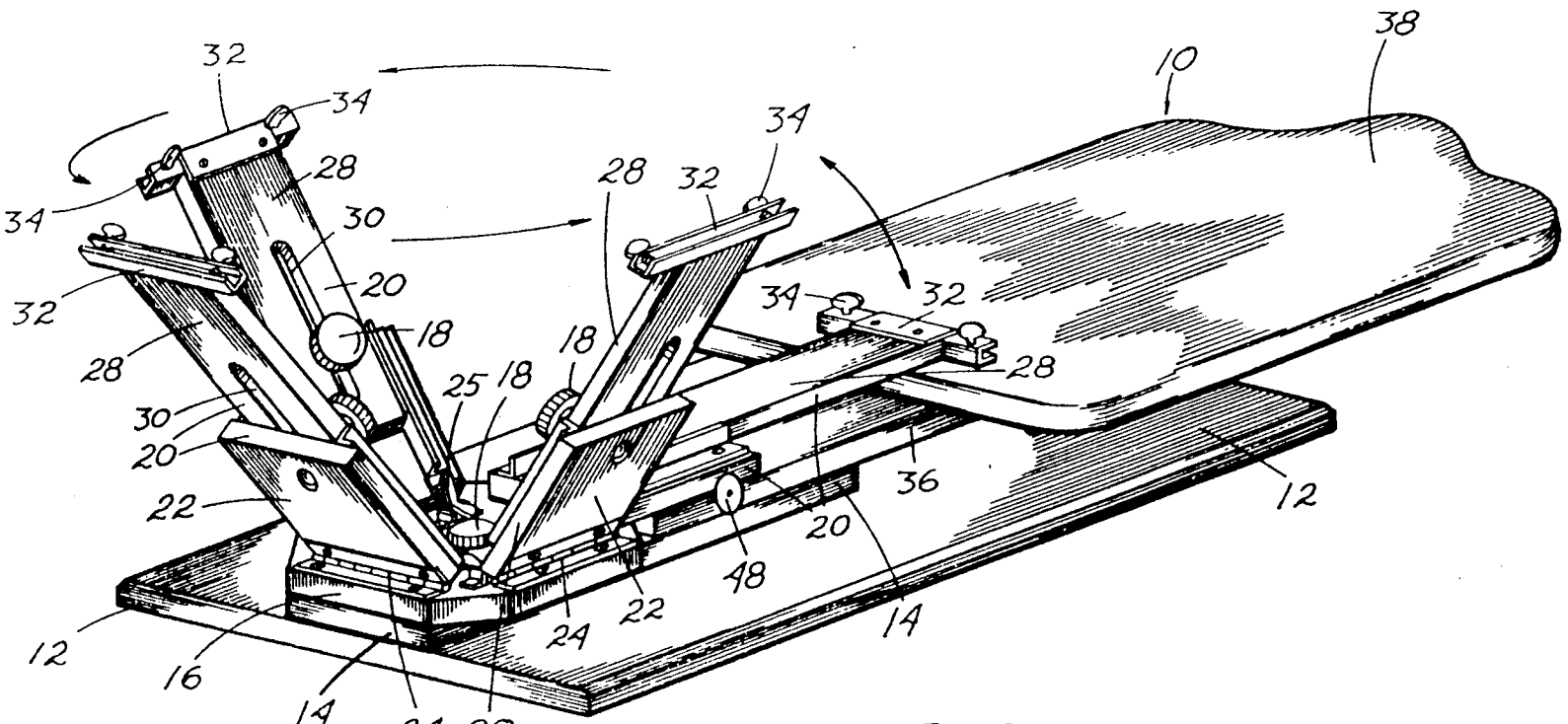
FIG. 1 is a perspective view of my thermal screen printer illustrating the rotation of the four screen holders.

Referring now to the drawings and to FIG. 1 where the four color embodiment 10 of the invention is illustrated in a perspective view. The four color screen printer 10 consists of a rectangular base support 12 which supports and balances the entire unit when placed on a sturdy level surface. Elevation plate 14 is a rectangular panel sized approximately one third the width and about one half the length of base support 12. Elevation plate 14 is positioned lengthwise along the top surface of base support 12 with one end abutting the center end edge of base support 12. Elevation plate 14 serves to elevate the rest of the device up from the surface of base plate 12. Located on the top surface of elevation plate 14, adjacent the end of base support 12, is pivotable plate 16. Pivotable plate 16 is an octagonal shaped rotational plate appearing as a square panel with forty-five degree angled corners. Pivotable plate 16 is rotationally affixed to elevation plate 14 by one centrally positioned threaded hand knob 18. Loosening hand knob 18 allows pivotable plate 16 to rotate about a threaded shaft on hand knob 18, and tightening hand knob 18 secures pivotable plate 16 in position. Hingedly affixed at the edge to the top surface of pivotable plate 16, parallel to the four larger of the eight sides, are four positionable screen holder assemblies 20. Each screen holder assembly 20 consists first of one hinged support plate 22 which is endwardly affixed to pivotable plate 16 by hinge 24. Each hinged support plate 22 can be positioned from an upwardly angled non-use or storage position to a horizontal use position. The storage position is maintained by releasable clasp 25. One section of clasp 25 is affixed to each corner of pivotable plate 16, adjacent the right hand corner of hinged support plate 22, and a second correlating section of clasp 25 is affixed to the top right hand corner of hinged support plate 22. The hinging system allows the major portion of hinged support plate 22 to extend outward towards the front end of base support 12 from the edge of pivotable plate 16 when in the horizontal or in-use position. Affixed to the top surface of hinged support plate 22 are two parallel extension plate guide tracks 26. Each guide track 26 is affixed edgewardly to the top surface, running parallel to the sides of hinged support plate 22, and perpendicular to hinge 24. Movably retained between both guide tracks 26 is the second part of screen holder assembly, extension plate 28. Extension plate 28 is an elongated rectangular panel approximately twice the length of hinged support plate 22 which is movably affixed by a second threaded hand knob 18. The shaft of threaded hand knob 18 is movably retained within an adjustment slot 30 which is located centrally lengthwise in extension plate 28. Loosening threaded hand knob 18 allows extension plate 28 to be moved lengthwise, either extending the distal end forward or retracting it back. The distal end of extension plate 28 is endwardly affixed with an elongated U-shaped channel 32 attached parallel to the end thereof with the open side facing outward. The free distal ends of U-shaped channel 32 extend outward past the sides of extension plate 28 a short distance and the top surface of each is affixed with thumb screws 34. The threaded shaft of each thumb screw 34 extends downward into the interior of the channel through a threaded aperture in the surface of U-shaped channel 32.

A second plate, platform support arm 36, is affixed toward the end of elevation plate 14 adjacent pivotable plate 16. Platform support arm 36 is an elongated rectangular plank which extends forward past the end of base support 12 and serves as the support structure for article support platform 38 which is the printing platen supporting a garment to be printed on. The forward end of hinged support plate 22 also rests on platform support arm 36 when in the in-use position. Article support platform 38 is a substantially rectangular plate the same width as base support 12 and has four rounded corners and a rounded projection extending outward from the front center edge.

Figure 2:
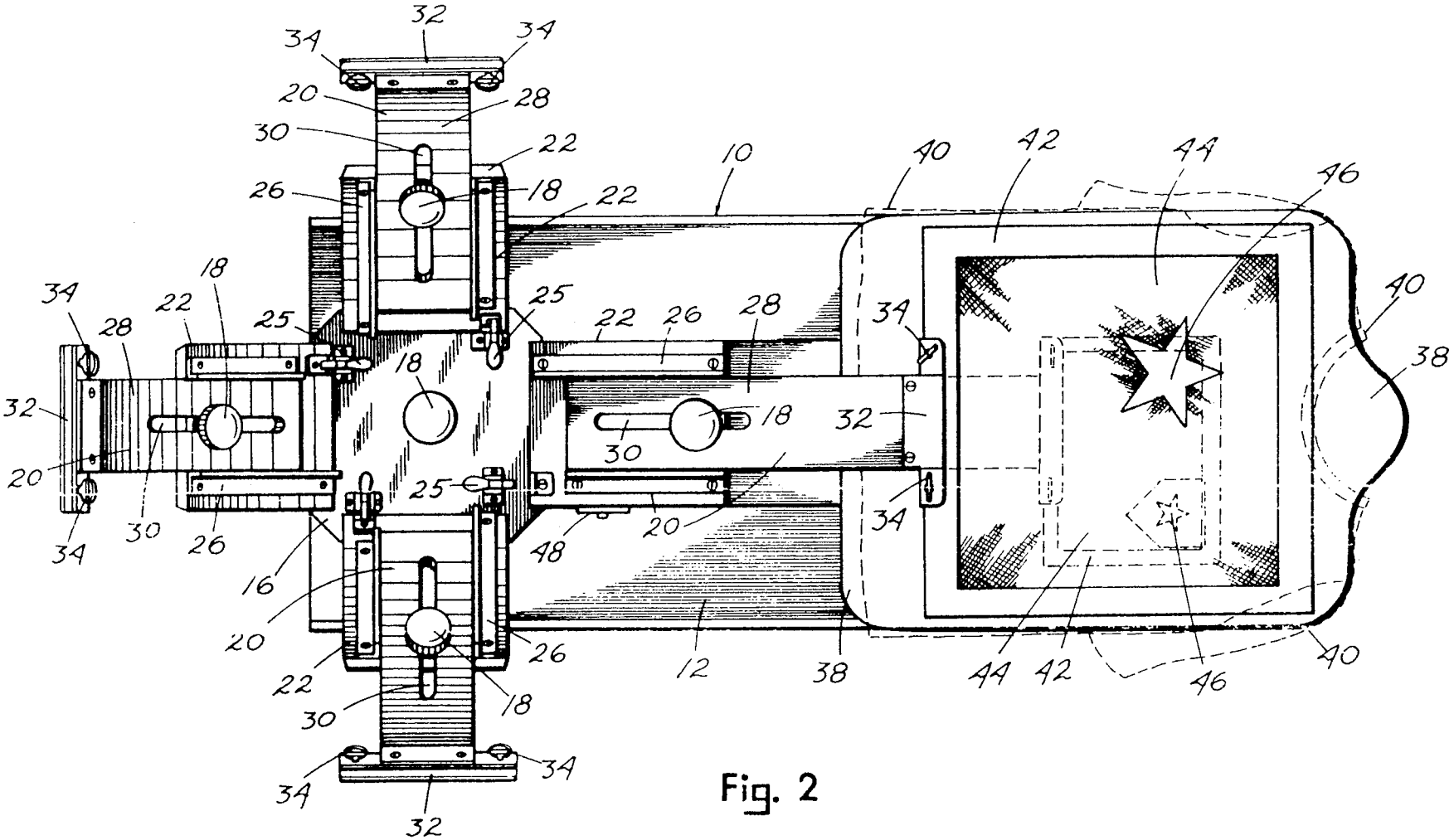
FIG. 2 is a top plan view of the FIG. 1 embodiment with a T-shirt, represented by the dotted outline, pulled over the garment support platform and a screen aligned over the T-shirt ready for printing. A second smaller screen, also indicated by a dotted outline, illustrates the extension of the screen clamp.
Figure 3:
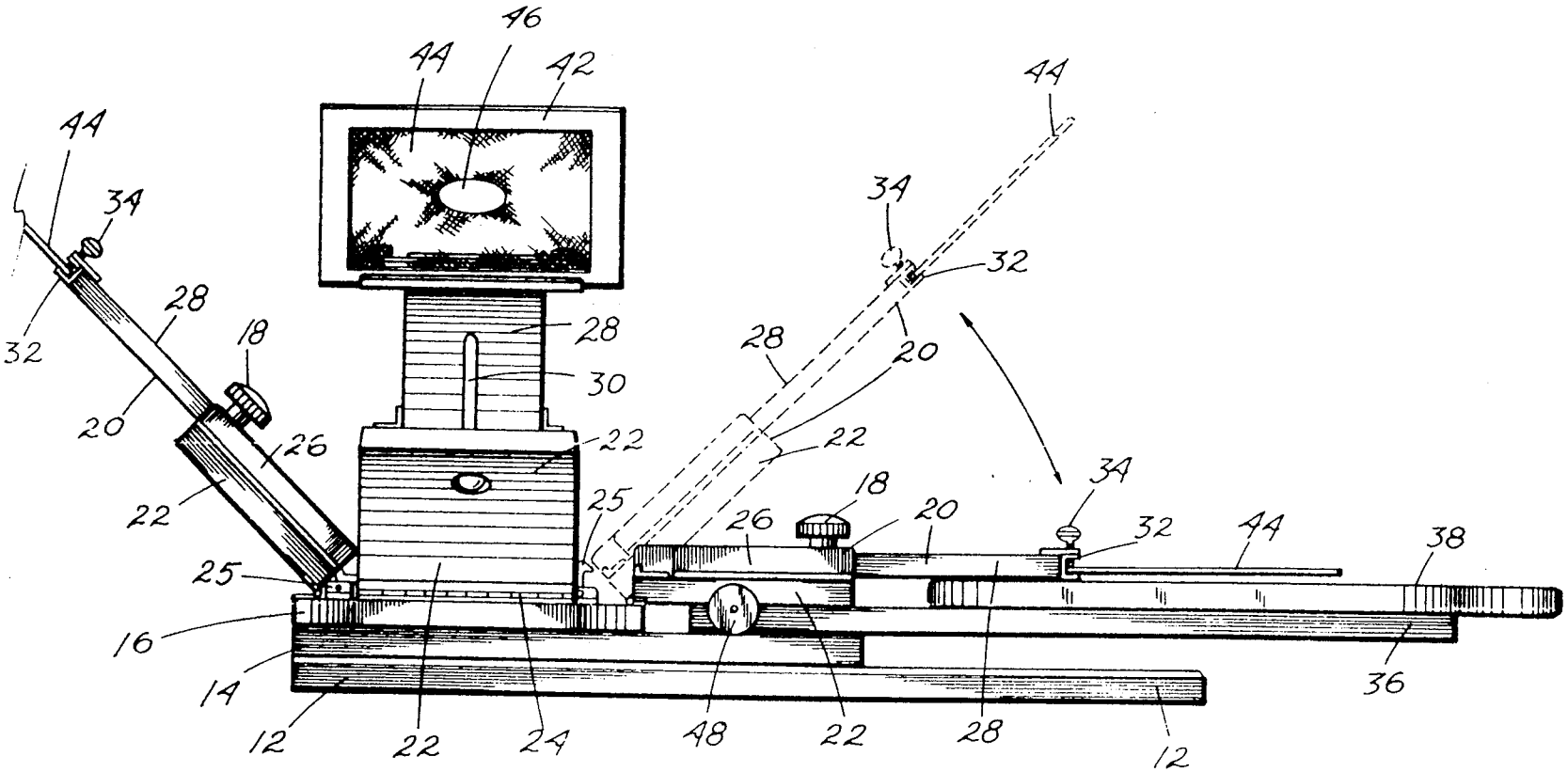
FIG. 3 is a side view of the four screen holder embodiment of the invention showing the horizontal in-use position and the upwardly angled stored position of the screens and screen holders.
Figure 4:
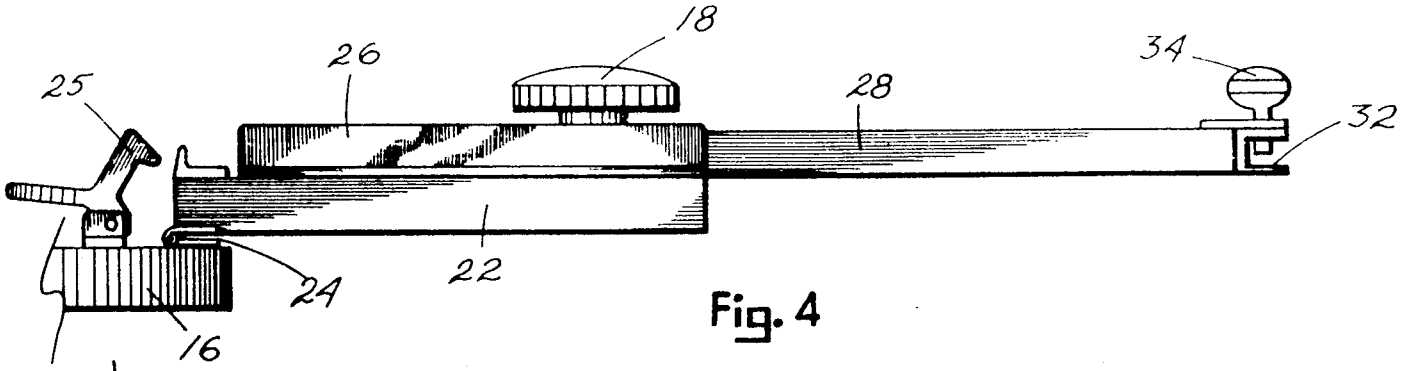
FIG. 4 is a right side view of the single screen holder embodiment of the invention.
Figure 5:
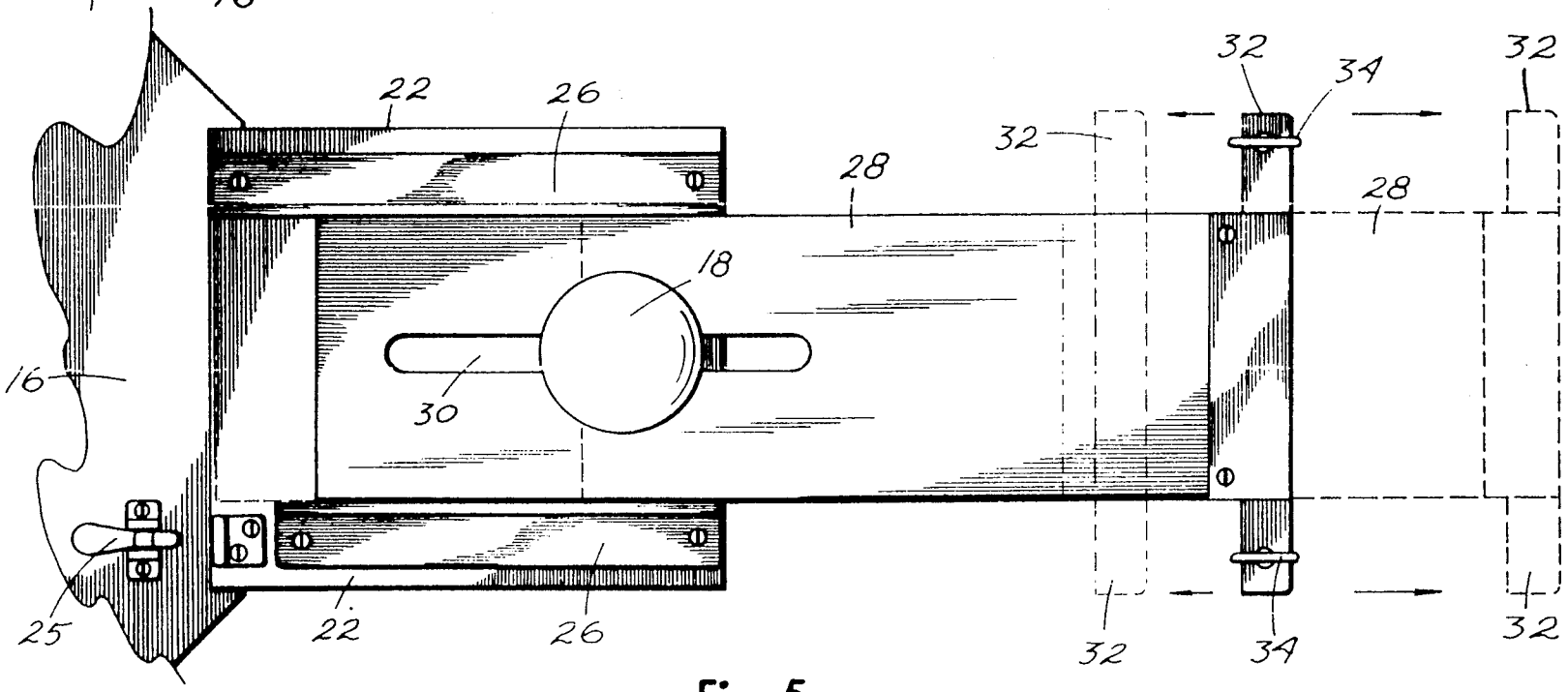
FIG. 5 is a top plan view of the FIG. 4 embodiment with the dotted outline representing the various positioning capability of the screen holder.
Figure 6:
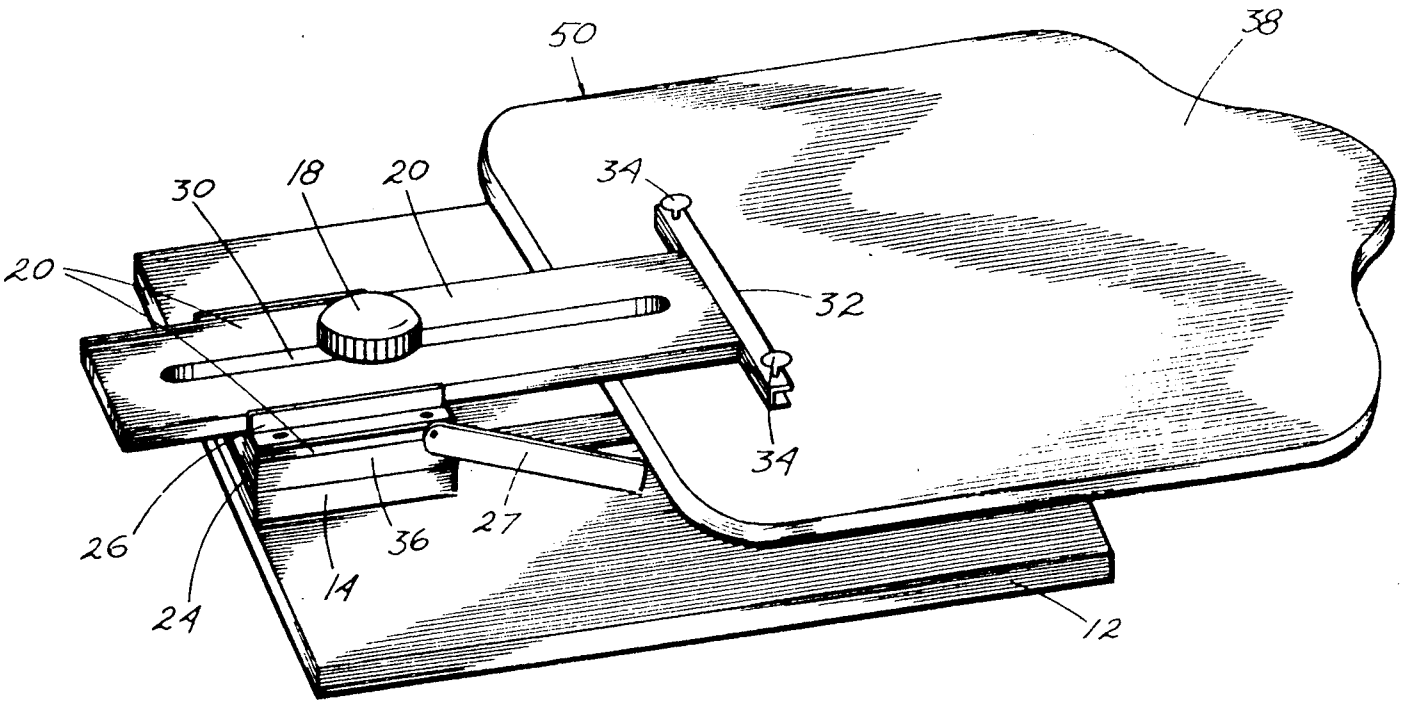
FIG. 6 shows the single screen holder embodiment in a perspective view.

In use, article support platform 38 fits inside between the front and back surface of garment 40, illustrated as a T-shirt in FIG. 2, with the neck opening resting over the rounded projection on the front edge. The side of garment 40 which is to be printed on is placed on the top surface of article support platform 38 with the opposite side positioned between platform support arm 36 and base support 12. With all four screen holder assemblies 20 positioned in a forty-five degree angle, each U-shaped channel 32 is fitted with the frame 42 section of thermal screen 44. Assuming four colors are to be used on the finished design 46, each screen 44 is designed to print a separate portion and color of design 46. With hand knob 18 of pivotable plate 16 loosened, one screen holder assembly 20 is roughly aligned with garment 40. Clasp 25 is then released which allows the distal end of screen holder assembly 20 with screen 44 to be lowered into a horizontal position. The thickness of hinged support plate 22 is equal to that of garment support platform 38 with platform support arm 36 being of equal thickness of pivotable plate 16, which allows the bottom surface U-shaped channel 32 to lie flush on the surface of garment support platform 38. Guide stop 48, illustrated in FIG. 1 and 3 as an annular disc, is positioned vertically along the right side of platform support arm 36. It extends upward past the top surface of platform support arm 36 and serves as an alignment indicator which helps to correctly position extension plate 28 by abutting the right side of hinged support plate 22 against the left side of guide stop 48. Extension plate 28 can now be repositioned longitudinally with the release of hand knob 18, to align design 46 located on screen 44 over the desired position on garment 40. Each of the remaining screen holder assemblies 20 can now also be accurately adjusted by measuring the distance from the bottom edge of extension plate 28 to the bottom edge of hinged support plate 22 of the screen holder assembly 20 now located in the in-use position. Lateral positioning of all screens 44 within U-shaped channels 32 can be correlated with one another by measuring the distance from the outer edge of frame 42 of screen 44 to the adjacent edge of U-shaped channel 32. Although not illustrated, spacing increments can be imprinted along the horizontal surfaces of extension plate guide tracks 26 and the top surface of U-shaped channel 32 for ease in measuring adjustments. With the first screen holder assembly 20 accurately positioned over garment 40, the printing process can be completed for that particular color. When finished, the next screen holder assembly 20 can be rotated clockwise, or counterclockwise if desired, and the printing process for that specific color completed. The process is continued until all four colors have been utilized. Although four colors are described as being used in this description, an infinite number of colors can be used by a continuing process of replacing used screens 44 with screens 44 for different colors.

A second embodiment of the invention, one color screen printer 50, is provided with a non-rotatable screen holder assembly 20. Pivotable plate 16 has been eliminated and the back end of platform support arm 36 is extended to align with the back end of elevation plate 14. Clasps 25, and guide stop 48 have been eliminated. Hinged support plate 22 is now retained in upwardly angled stored position by pivotal leg 27. Extension plate 28 is still positionable within guide tracks 26. One color screen printer 50 can actually be used for multi-color printing if time is taken to exchange and realign each separate screen 44 for each separate color to be printed. This embodiment is considerably more compact than the four color embodiment and therefore easier to transport.

The suggested material of manufacture of the main frame of both embodiments is wood although metal or plastic can also be used. In the drawings, U-shaped channel 32 is illustrated being narrow in structure, accepting only screens 44 with flat frames 42, enlargement of the opening of U-shaped channel 32 sufficiently to allow larger widths of frames 42 is possible. Extension of the size of U-shaped channel 32 in such a case would necessarily have to project upward to maintain the flush bottom ledge of U-shaped channel 32 with the surface of article support platform 38.

Although I have described both embodiments of my invention in length in the previous specification, it is to be understood that modifications may be practiced in the structure and design of both embodiments insofar as those modifications do not exceed the coverage designated by the appended claims.

What I claim as my invention is:

1. A screen printing apparatus with multiple positionable screen holder assemblies for use with variously sized print screens to print colors on an article, comprising:

(a) a support base;

(b) an elevational plate affixed to and extending upwardly from said support base;

(c) a pivotable plate supporting said positionable screen holder assemblies, said pivotable plate being attached rotatably to said elevation plate;

(d) releasable attachment and holding means attached to said pivotable plate for attaching said pivotable plate rotatably to said elevation plate and for temporarily maintaining said pivotable plate in different fixed positions;

(e) hinging means attaching said positionable screen holder assemblies to said pivotable plate;

(f) releasable clasp means for temporarily maintaining said positionable screen holder assemblies in fixed printing positions;

(g) releasable clasp means for temporarily maintaining said positionable screen holder assemblies in an upwardly angled stored position;

(h) releasable attachment means for holding differently sized print screens for printing in said positionable screen holder assemblies;

(i) at least one article support platform;

(j) attachment means for attaching said article support platform to said elevation platform.

* * * * *

UNITED STATES PATENT AND TRADEMARK OFFICE

CERTIFICATE OF CORRECTION

PATENT NO. : 5,018,441

DATED : May 28, 1991

INVENTOR(S) : Humbert G. Miraglia, Jr.

It is certified that error appears in the above-identified patent and that said Letters Patent is hereby corrected as shown below:

Column 6, line 22, delete "clasp" and insert --holding-- therefore.

Signed and Sealed this

Second Day of November, 1993

Bruce Lehman

*Attest:*

BRUCE LEHMAN

*Attesting Officer*

*Commissioner of Patents and Trademarks*